US010919691B2

(12) United States Patent
Kaiserman

(10) Patent No.: US 10,919,691 B2
(45) Date of Patent: Feb. 16, 2021

(54) BEVERAGE CARTRIDGE WITH NEEDLE PUNCTURE PREVENTION

(71) Applicant: Ideators, LLC, New York, NY (US)

(72) Inventor: Terrance Kaiserman, Loxahatchee, FL (US)

(73) Assignee: Ideators, LLC, New York, NY (US)

( * ) Notice: Subject to any disclaimer, the term of this patent is extended or adjusted under 35 U.S.C. 154(b) by 240 days.

(21) Appl. No.: 15/946,371

(22) Filed: Apr. 5, 2018

(65) Prior Publication Data

US 2019/0308804 A1 Oct. 10, 2019

(51) Int. Cl.
*B65D 85/804* (2006.01)

(52) U.S. Cl.
CPC ..... *B65D 85/8043* (2013.01)

(58) Field of Classification Search
CPC ..... B65D 85/8043
See application file for complete search history.

(56) References Cited

U.S. PATENT DOCUMENTS

| | | | |
|---|---|---|---|
| 5,124,177 | A | 6/1992 | Kasmark, Jr. et al. |
| 5,298,267 | A | 3/1994 | Gruenbacher |
| 5,840,189 | A | 11/1998 | Sylvan et al. |
| 5,885,633 | A | 3/1999 | Lehrer |
| 5,932,260 | A | 8/1999 | Soughan |
| RE36,516 | E | 1/2000 | Lehrer |
| 6,607,762 | B2 | 8/2003 | Lazaris et al. |
| 7,069,837 | B2 | 7/2006 | Sachtleben |
| 7,398,726 | B2 | 7/2008 | Streeter et al. |
| 7,543,527 | B2 | 6/2009 | Schmed |
| 8,245,854 | B2 | 8/2012 | Hassebrauck |
| 2001/0010297 | A1* | 8/2001 | Pulek ..... B01D 29/111 210/493.2 |
| 2002/0066700 | A1 | 6/2002 | Dolfel et al. |
| 2005/0051478 | A1 | 3/2005 | Karanikos et al. |
| 2006/0065127 | A1 | 3/2006 | Dalton et al. |
| 2009/0095164 | A1 | 4/2009 | Celeste |
| 2010/0239733 | A1 | 9/2010 | Yoakim et al. |
| 2012/0058226 | A1 | 3/2012 | Winkler et al. |
| 2014/0161940 | A1 | 6/2014 | Aviles et al. |
| 2015/0216348 | A1 | 8/2015 | Aus Der Fuenten et al. |
| 2016/0244250 | A1 | 8/2016 | Dolan, Jr. |
| 2018/0160845 | A1* | 6/2018 | Beaulieu ..... B65D 85/8043 |

FOREIGN PATENT DOCUMENTS

| | | | |
|---|---|---|---|
| EP | 0615921 | A1 | 9/1994 |

OTHER PUBLICATIONS

International Search Report from PCT/US17/68171, dated Feb. 22, 2018, 24 pages.

* cited by examiner

*Primary Examiner* — Viren A Thakur
*Assistant Examiner* — Chaim A Smith
(74) *Attorney, Agent, or Firm* — Lerner, David, Littenberg, Krumholz & Mentlik, LLP

(57) ABSTRACT

The disclosure provides a beverage cartridge which includes a filter. The filter, comprising filter material, is arranged to separate the cartridge into first and second compartments. The first compartment stores a first substance and is positioned adjacent the second compartment. A coating is arranged on the filter material and the coating increases the puncture resistance of the filter material.

14 Claims, 6 Drawing Sheets

BEVERAGE CARTRIDGE WITH NEEDLE PUNCTURE PREVENTION

BACKGROUND

Cartridges for use with beverage making machines are well known, and can include one or more filters as well as a beverage medium, such as ground coffee beans, tea leaves, etc. In some cartridges, the filter is located between two or more portions of an interior space (e.g., one portion in which a beverage medium is located and a second portion into which liquid that has passed through the permeable filter can flow). Examples of such cartridges are disclosed in U.S. Pat. Nos. 5,840,189 and 6,607,762. Those cartridges can be used with a beverage making machine like that described in U.S. Pat. No. 7,398,726. The disclosures of U.S. Pat. Nos. 5,840,189; 6,607,762; and 7,398,726 are hereby incorporated by reference in their respective entireties.

In use, the beverage making machine introduces a pressurized fluid into a cartridge. The pressurized liquid may make contact with the beverage medium as it percolates through a filter. Depending upon the permeability of the filter, the pressure of the liquid, and the amount of the liquid introduced into the cartridge the strength of the final beverage may be adjusted. In this regard, the permeability of the filter and pressure of the liquid may control the flow rate of the pressurized fluid through the filter, and thereby control the amount of time the pressurized fluid is in contact with the beverage medium. Longer contact typically results in increased extraction of the beverage medium, thereby leading to a stronger final beverage.

The strength of the final beverage may be limited by the amount of beverage medium within the cartridge. In this regard, the amount of beverage medium in the cartridge is typically limited by the size of the cartridge itself. As cartridge sizes are typically standardized for each beverage making machine, increasing the size of the cartridge to increase the amount of beverage medium capable of being stored therein, is generally not possible. Thus, the strength of the final beverages produced by the beverage making machines has been limited.

BRIEF SUMMARY

Aspects of the disclosure provide for a beverage cartridge. The beverage cartridge comprising: a filter comprising of filter material arranged to separate the cartridge into first and second compartments, wherein the first compartment stores a first substance and is positioned adjacent the second compartment; a coating arranged on the filter material, wherein the coating increases the puncture resistance of the filter material. A first side of the filter may be within the first compartment, and a second, opposite side of the filter may be within the second compartment.

In some instances, the beverage cartridge may include a sidewall; a bottom; and an opening arranged at an end of the first compartment and a lid sealing the opening, wherein cartridge has a frustoconical shape. The coating may be relatively impermeable to fluids compared to the filter material. The coating may be printed directly onto at least one portion of the filter material. The coating may comprise an ink including a solvent based resin, a water based resin, a free radical based resin, an oil based resin, a plastisol, and an organosol.

In some instances the coating may comprise urethane and epoxy. In some examples, the coating may comprise first and second layers of urethane and the epoxy is positioned between the two urethane layers. The first urethane layer may be printed directly on the filter material, the epoxy may be printed over at least a portion of the first urethane layer, and the second urethane layer may be printed over the epoxy. The epoxy may be completely enclosed by the first and second urethane layers. The first and second urethane layers may each be about 2 mm thick.

In some examples at least one supplement may be printed on the coating. The supplement may be selected from the group consisting of flavorings, fragrances, pharmaceuticals, and nutrative compounds.

Another aspect of the disclosure provides for a beverage cartridge comprising a filter comprised of a filter material; an enclosure at least substantially surrounding said filter; a coating arranged on the filter material, wherein the coating increases the puncture resistance of the filter material.

In some examples the coating may comprise urethane and epoxy. In some instances, the coating comprises first and second layers of urethane and the epoxy may be positioned between two urethane layers. In some examples the first urethane layer may be printed directly on the filter material, the epoxy may be printed over at least a portion of the first urethane layer, and the second urethane layer may be printed over the epoxy. The epoxy may be completely enclosed by the first and second urethane layers.

In some instance, the first and second urethane layers are each about 2 mm thick.

In some examples, the enclosure may comprise first and second compartments, a first side of the filter is within the first compartment, and a second, opposite side of the filter is within the second compartment. A first substance may be arranged on the first side of the filter.

DETAILED DESCRIPTION

Figure 1:
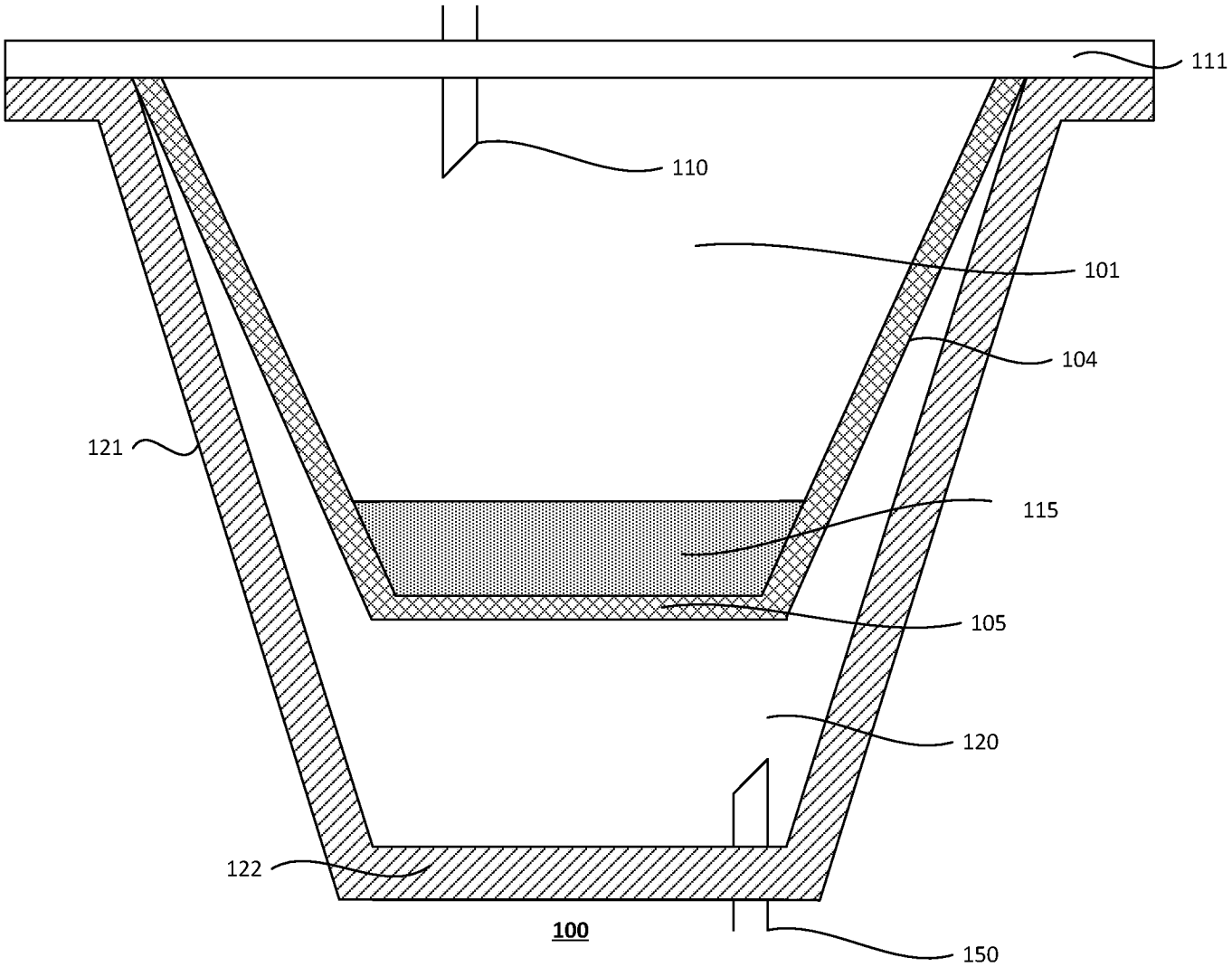
PRIOR ART FIGURE 1
FIG. 1 is an illustration of a prior art cartridge and filter.

As previously discussed, known cartridges are limited in that they are configured to contain a filter which allows a pressurized fluid which has extracted a beverage medium to percolate through the filter at a particular flow rate. FIG. 1 illustrates one such cartridge 100. The cartridge 100 may be used in a beverage forming machine which introduces a pressurized fluid into the cartridge via an externally located injection needle 110 which penetrates a lid 111.

A filter 104 may be positioned to divide the cartridge into two compartments 101 and 120. The filter 104 may be considered a short fluted filter, as the base of the filter 105 is positioned with sufficient distance from the base of the cartridge 122 to avoid having the extraction needle 150 contact the base of the filter 105. The short fluid configuration avoids the risk of the extraction needle 150 from piercing the filter 104 when the extraction needle pierces the base of the cartridge 122. The first compartment 101 may include the area located between the filter 104 and the lid 111. The second compartment 120 may include the area between the filter 104 and the side walls 121 and the base 122 of the cartridge.

A beverage medium 115, such as coffee grounds, may be positioned within the first compartment 101. The filter 104 may be constructed and positioned such that it prevents the beverage medium 115 from passing into the second compartment 120. Upon the injection needle 110 introducing a pressurized fluid, such as water into the cartridge, the pressurized fluid may pass through the beverage medium 115 and percolate through the filter 104 with the extract from the beverage medium 115 into the second compartment 120. The side walls 121 or base 122 of the cartridge may be pierced by an externally located extraction needle 150 to release the pressurized fluid containing the extract from the beverage medium 115. Although the embodiments disclosed herein discuss beverage mediums, other substances such as food substances, supplements, other such substances may be used in place of, or in combination with, a beverage medium.

Upon a pressurized fluid being injected into the first compartment 101, pressure may build within the first compartment 101. To avoid failure (e.g., tears, cracks, joint failures, etc.,) of the filter 104, lid 111, side walls 121, base 122, or other portions of the cartridge 100, the pressure within the first compartment, as well as the second compartment should be maintained within an operable range of pressures, such as 0-15 PSI, or more or less.

The increase in pressure within the first compartment 101 is dependent upon the rate of flow of the pressurized fluid through the beverage medium 115 and filter 104, as well as the rate of injection of the pressurized fluid into the first compartment 101. In this regard, the pressurized fluid introduced into the first compartment by the injection needle 110 needs space within the first compartment 110 to go, otherwise the pressurized fluid will cause a failure within the cartridge, such as tearing the filter, thereby spilling the beverage medium into the second compartment and subsequently into the finished beverage (i.e., the pressurized fluid which has traveled through the filter and beverage medium, as well as the extract of the beverage medium.) In some instances, upon the pressurized fluid having no space within the first compartment 110, the pressurized fluid may back up and travel out of the lid and/or back into the injection needle 110, thereby leading to spills of the pressurized fluid and potentially failure of the beverage making machine.

To maintain the pressure within the first compartment within the operable range of pressures, the pressurized fluid injected into the first compartment should continually flow through the beverage medium 115 and filter 104 at a rate which maintains space for additional pressurized fluid to be introduced by the injection needle. In this regard, the permeability of the filter and the amount of beverage medium 115 within the first compartment may restrict the flow of the pressurized fluid from the first compartment to the second compartment. As such, the permeability of the filter and the amount of beverage medium within the first compartment should be controlled such that the rate of flow of the pressurized fluid from the first compartment 101 to the second compartment 120 prevents the pressure within the first compartment from going outside the operable range pressures. Moreover, the finished beverage, should be removed from the second compartment 120 at the same or greater rate than the rate of flow of the pressurized fluid through the beverage medium 115 and filter 104 to assure pressure within the second compartment stays within the operable range and also to allow the pressurized fluid to flow from the first to second compartments unimpeded.

To allow for acceptable extraction levels of the beverage medium 115 to occur such that a sufficiently strong finished beverage is produced, the pressurized fluid may need to remain in contact with the beverage medium for a certain length of time. To assist the pressurized fluid in maintaining contact with the beverage medium, a greater amount of beverage medium 115 may be positioned within the first compartment and/or the permeability of the filter 104 may be reduced. However, reducing permeability of the filter 104 and increasing the amount of beverage medium within the first compartment 101 may result in the pressure within the first compartment increasing out of the operable range of pressures during use.

Figure 2:
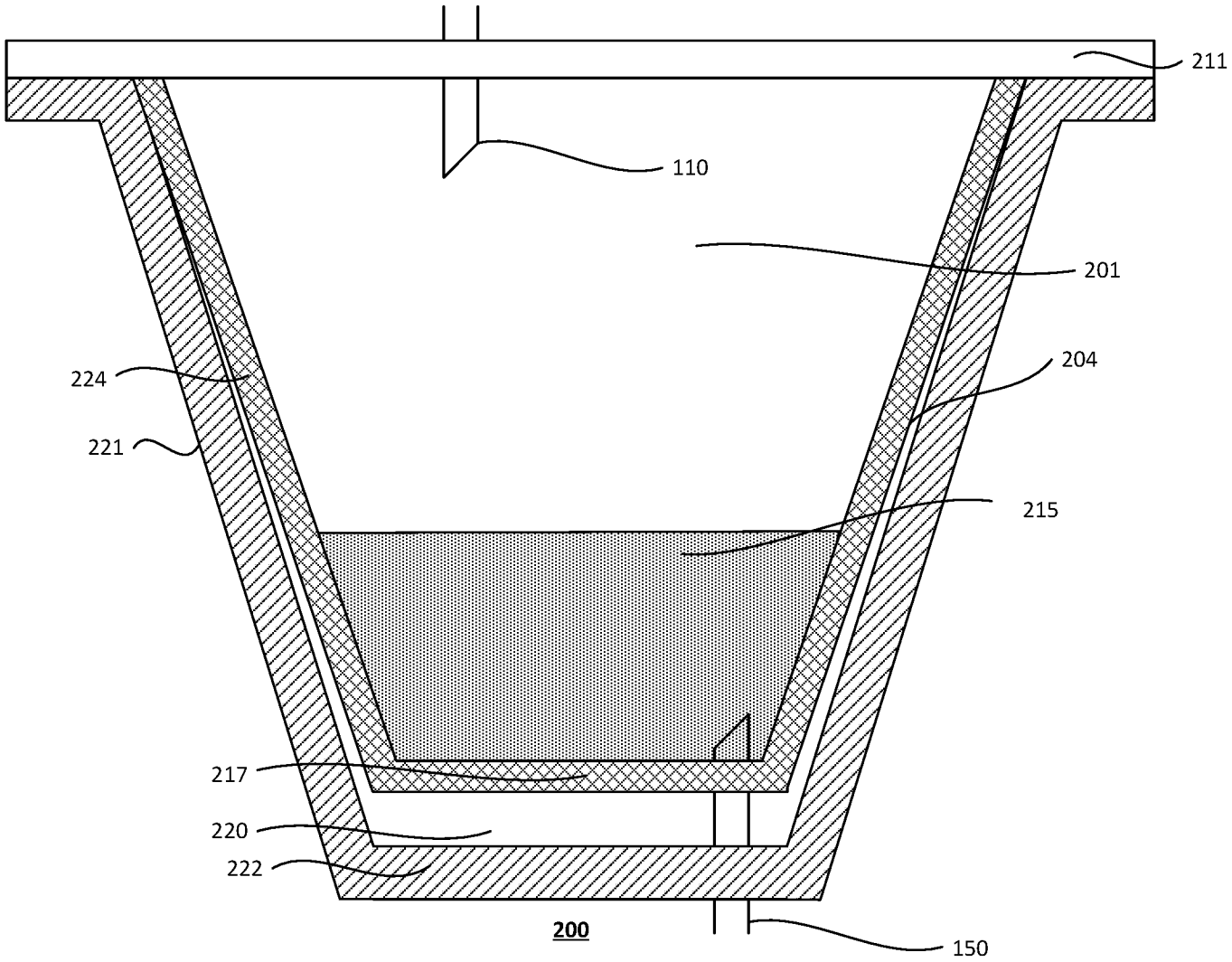
PRIOR ART FIGURE 2
FIG. 2 is an illustration of a cartridge and filter in accordance with one aspect of the present invention.

The size of the filter may be increased to allow for additional beverage medium to be positioned within the first compartment. For example, FIG. 2 shows a side cross-sectional view of a cartridge 200 that incorporates a longer filter, such as long fluted filter 204. In comparison with the filter 104 of cartridge 100, filter 204 has elongated side walls 224 which allow the filter to extend closer to the base 222 of the cartridge. In some instances, the side walls of the filter 204 may be configured such that the base of the filter 217 rests on the base of the cartridge 222. By increasing the size of the filter 204, more room is created for the beverage medium 215 to be positioned while still allowing space for the pressurized fluid to be introduced, thereby allowing for more beverage medium 215 to be used relative to known cartridges while maintaining the pressure within the cartridge within an operable range, such as when injection needle 110 pierces the lid 211 and injects a pressurized fluid into the first compartment 201.

The increased size of the filter 204 may be prone to piercing or puncture by the extraction needle 150 when it pierces the base of the cartridge 200. In this regard, the finished beverage may be removed from the cartridge 200 by an extraction needle 150 piercing the side walls 221 or base 222 of the cartridge, thereby allowing the finished beverage to flow through and/or around the extraction needle out of the cartridge 200. However, the larger size of filter 204 may make the filter prone to being pierced by the extraction needle. For instance, as shown in FIG. 2, extraction needle 150 may pierce through the base of filter 217 into the first compartment 201. As a result, the beverage medium 215 may pass through the hole created in the filter 204 by the extraction needle into the second compartment 220 and/or the finished beverage.

In some instances, upon the pressurized fluid being injected into the first compartment, the pressurized fluid may force filter 204 onto the extraction needle 150. Upon a certain amount of force being placed on the filter 204 at the location where the filter 204 contacts the extraction needle 150, the filter may be punctured by the extraction needle. Although FIG. 2 illustrates the base of the filter 217 being pierced, side walls 224 of the filter may also be pierced.

Figure 3:
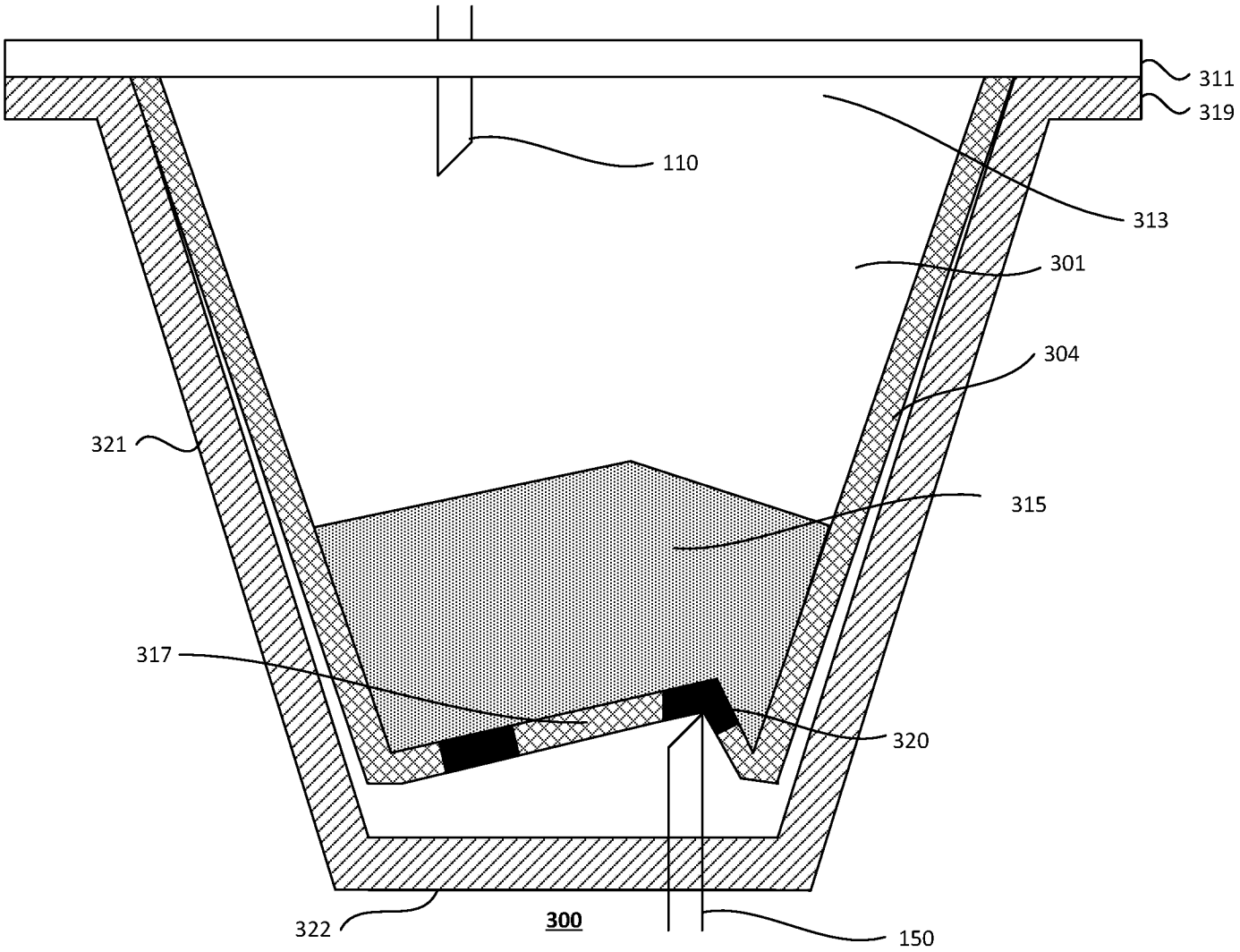
FIG. 3 is an illustration of a cartridge and filter with a coating in accordance with one aspect of the present invention.

A coating may be applied to the filter, such as the long fluted filter of FIG. 2, to prevent the extraction needle from piercing, puncturing, or otherwise breaking the filter. For instance, as shown in FIG. 3, a coating 320 is applied to the base 317 of the filter 304, which may be compared to filter 204. The coating may be a material capable of resisting puncture, piercing, or other such breaking by the extraction needle 150. In this regard, upon the extraction needle contacting the coated portion of the filter 304, the extraction needle 150 may move the filter and beverage medium contained within the first compartment 301, but not pierce, puncture, or otherwise tear the filter 304. In this regard, the coating provides a piercing protective barrier on the filter at locations where it is applied.

In the embodiment shown in FIG. 3, the cartridge 300 may have a frustoconical cup shape formed by sidewalls 321, bottom 322, and an opening 313. Alternatively, the shape of the cartridge 300 may be rectangular, spherical, semi-spherical, square, fluted, conical, cylindrical, etc. Additionally, the cartridge 300 may have a fluted, corrugated, smooth and/or otherwise shaped sidewalls 321 and bottom 322. In some instances, the cartridge 300 may not have a defined shape. In this regard, although the cartridge 300 illustrated in FIG. 3 is of a relatively rigid and/or resilient construction so that the cartridge 300 tends to maintain its shape, the cartridge 300 may be made to have a more compliant and/or deformable arrangement, such as a sachet cartridge made from a sheet of deformable material. The cartridge may be a single serve cartridge, multi-use cartridge, or other such cartridge.

The opening 313 can be closed by a lid. In this regard, the lid 311 may cover a portion or all of the opening 313. The lid may be made of any material typically used to cover a cartridge, such as plastic, foil, and/or polymer laminate material. For example, lid 311 of FIG. 3 may be a foil polymer laminate material that is attached to the rim 319 of cartridge 300.

Although the rim 319 is arranged as an annular flange-like element in FIG. 3, in alternate embodiments the rim 319 can be arranged in other ways. For example, the rim 319 can be the top edge of the side wall 321 without any flange element. In some instances the cartridge 300 may not include a rim. In this scenario, the lid 311 may be attached directly to the cartridge's side walls 321, and/or other components of the cartridge. In some embodiments the cartridge 300 may be self-sealing, thereby not having an opening 313, negating the need for the lid 311.

The cartridge 300, and/or the lid 311 may provide a barrier to moisture and/or gases, such as oxygen. For example, the cartridge 300, including the side walls 321 and bottom 322, as well as the lid 311 may be made of one or more of a polymer laminate such as a sheet including a layer of polystyrene or polypropylene and a layer of ethylene vinyl alcohol (EVOH) and/or other barrier material, such as a metallic foil. The barrier created by the materials comprising the cartridge 300 and lid 311 may provide protection for substances within the cartridge 300, such as beverage medium 315, from unwanted exposure to moisture, oxygen and/or other materials. As such, the substances within the cartridge may have a longer shelf-life.

In some embodiments the cartridge may be comprised of one or more of polymers, biopolymers, compostable polymers, metals, ceramic, 3d-printable materials, nylon, polypropylene, paper, foils, etc. It should be understood, however, that the cartridge 300 and/or the lid 311 may be made of other materials or combinations of materials, such as biopolymers, compostable polymers, paper, foils, etc.

The interior size of the cartridge 300 may be configured such that its interior space, as defined by the space within the side walls 321, base 322, and/or lid 311, may be any size. The interior space within cartridge 300 may be limited by the shape of the lid 311. For instance, a lid which extends upwards above the rim 319 of cartridge 300 may result in a larger interior space while a lid which penetrates into the cartridge (i.e., extends below the rim towards the base 322,) may result in a smaller interior space.

The filter 304 is arranged to separate the first compartment 301 from the second compartment 320. The first compartment 301 is arranged adjacent to the second compartment 320. As used herein, one compartment being "adjacent" to another compartment means that such compartment is next to or within the other compartment.

The filter 304 may include any suitable material capable of maintaining a substance, such as beverage medium 315 in the first compartment 201, while allowing a fluid, such as pressurized fluid to pass through the filter to the second compartment 320. In some embodiments the filter may include a piece of filter paper, such as 30-40 gram Glatfelter, or more or less, that is arranged to allow a fluid and dissolved and/or suspended materials of a certain size to pass through, yet prevent relatively large particles from passing through. In this regard, the filter 304 may maintain beverage medium 315, such as coffee grounds, having a first size incapable of passing through the filter, within the first compartment 301. In some instances, the filter may be made of filter paper comprised of bleached and/or unbleached pulp filaments approximately 20 micrometers wide, or more or less. In some embodiments the filter 304 may be made of a filter material including synthetic materials such as polyethylene, polypropylene or other materials such as cellulosic materials, natural or synthetic materials, permeable or impermeable plastic material, a sponge like material, foam, ceramic, zeolites, cellulose, natural and/or synthetic fabrics, etc., and/or combinations and layers of such materials. Further, the filter 304 may be crimped and/or configured into a specific shape such as a basket-shape as shown in FIG. 3, a frustoconical shape, square, a flat disc, etc.

The filter 304 may be attached to the rim 319 of the cartridge side walls 321. For instance, as further shown in FIG. 3, an upper portion of the filter 304 may extend radially outwardly toward the cartridge side walls 321 and attach to the rim 319 of the cartridge 300 such that the upper portion of the filter 304 is sandwiched between the lid 311 and the rim 319 and/or attached directly to the rim. The filter 304 can be attached to the lid 311 and/or cartridge 300 in any suitable way, such as by an adhesive, thermal welding, ultrasonic welding, over-molding, chemical bonding, crimping or other mechanical bonding, etc. As can be seen in FIG. 3, the upper portion of the filter 304 that may be attached to the rim 319 can have an annular, or washer-like shape that extends radially outwardly toward the cartridge side walls 317, but such radial extension is not required. In some embodiments the lid 311 may extend radially inward. In some embodiments the filter 304 may be attached directly to the lid 311 or another portion of the cartridge 300. As such, the filter 304 may be suspended from the lid 311 and the first compartment may be positioned between the filter 304 and the lid 311.

A pressurized fluid, such as water, may be introduced into the first compartment 301 of the cartridge 300 via externally located injection needle 110. The pressurized fluid may contact the beverage medium 315 thereby extracting dissolved and/or suspended materials from the beverage medium 315. The pressurized fluid including the suspended material of a size smaller than the pores of the filter paper may start to permeate the filter 304 and move into the second compartment 320. The filter may prevent the beverage medium 315 from moving into the second compartment 320.

The filter 304 may be designed to achieve performance attributes which determine with the characteristics of the final product (i.e., the pressurized fluid after extraction of the substance.) The performance attributes may include one or more of beverage weight over time (e.g., the flow through the cartridge over time), final beverage weight, total dissolved solids in the pressurized fluid from the substance being extracted, and pressure within the cartridge and/or compartment, such as compartment 301. As discussed herein, in order to achieve acceptable extraction of a substance, such as beverage medium 315 in cartridge 300 of FIG. 3, the pressurized fluid injected into the cartridge 300 may need to remain in contact with the beverage substance for a certain length of time. This may be accomplished by using a filter of a particular permeability and/or size, as well as including more beverage medium in the cartridge. For instance, the first compartment 301 of cartridge 300 may include a larger amount of beverage medium than found in typical cartridges, such as cartridge 100. Thus, the pressurized fluid will migrate through more of the beverage medium 315, thereby extracting more of the beverage medium 315, before the pressurized fluid percolates through the filter 304. As such, a stronger finished beverage may be produced. To assure the pressure within the cartridge remains within an operable range, the permeability of the filter may be a particular permeability, such as 20 mm or more or less.

Figure 5A:
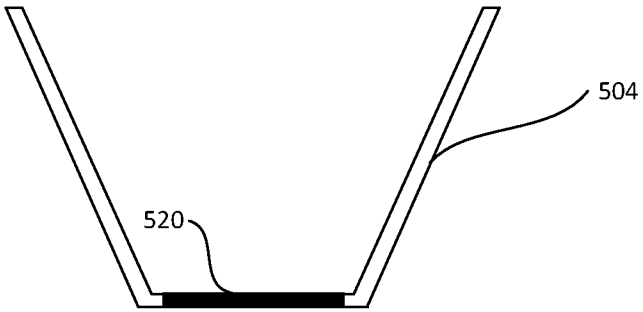
FIGS. 5A and 5B are additional illustrations of filters with coating patterns in accordance with one aspect of the present invention.
Figure 5B:
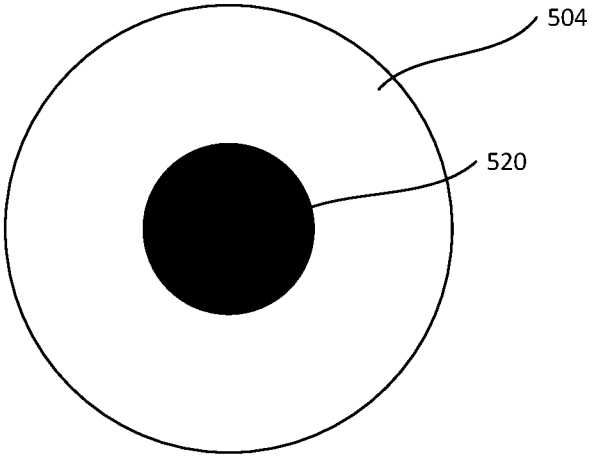
Figure 4A:
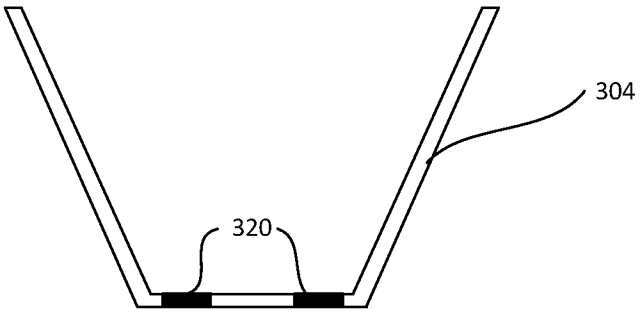
FIGS. 4A and 4B are illustrations of filters with coating patterns in accordance with one aspect of the present invention.
Figure 4B:
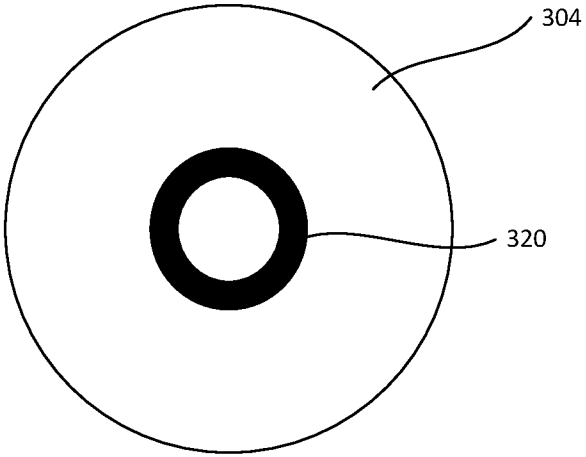

The coating may be applied to filter at a location or locations where the extraction needle may contact the filter. As typical filters used in cartridges are conical and/or have a round base, coatings may be applied in circular or ring patterns to allow the cartridge to be inserted in any rotational position within the beverage making machine. For instance, FIGS. 4A and 4B show a side and top view, respectively, of a filter 301 with a ring shaped coating 320 applied. FIGS. 5A and 5B show a side and top view, respectively, of a filter 501 with a circular coating 520 applied. When positioned in a cartridge, both the circular coating 520 and the ring shaped coating 320 may be located at the position where the extraction needle 150 may contact the filter. Although the figures illustrate coatings only on the base of the filter, coatings may be applied to the side walls and/or a combination of the base and side walls of the filter. Moreover, any pattern(s) or design(s) of coating may be applied to a filter, such as dots at particular locations, concentric rings, multiple circular coatings, etc. In some instances, the coatings may be combinations of two or more patterns. In some instances, the filter may be a sealed sachet within a cartridge, with all of, or only a portion of the sachet where the extraction needle may make contact with the sachet having a coating. The shape of each filter 301 and 501 are shows as being frustoconical, although the filters may be of any shape, such as square, rectangular, triangular, etc.

The coatings, such as coatings 320 and 520, may include one or more layers of compositions, such as an ink, comprised of one or more solvent based resins, water based resins, free radical based resins, oil based resins, plastisols, and organosols. Such resins may include, but are not limited to acrylarnide, acrylics, phenolics, bisphenol A type epoxy, non-bisphenol A type epoxy, shellac, carboxymethyl cellulose, cellulose acetate butyrate, cellulosics, chlorinated polyether, chlorinated rubber, epoxy esters, ethylene vinyl acetate copolymers, polyurethane, styrene, butadiene, nitrocellulose, maleics, melamine, natural resins, isocyanates, hydrogenated resin, polyamide, polycarbonate, rosins, polyesters, polyethylene, polyolefins, polypropylene, polystyrene, polyurethane, polyvinyl acetate, silicone, vinyls, and water thinned resins. Additional suitable resins for ink include 100% solids oligomers of all types and monomers of all types.

In some instances the coatings may be configured such that they are resistant to certain chemicals, do not soften when exposed to certain temperature, such as 150 degrees Fahrenheit, or more or less, and have strong tensile strength.

Figure 6A:
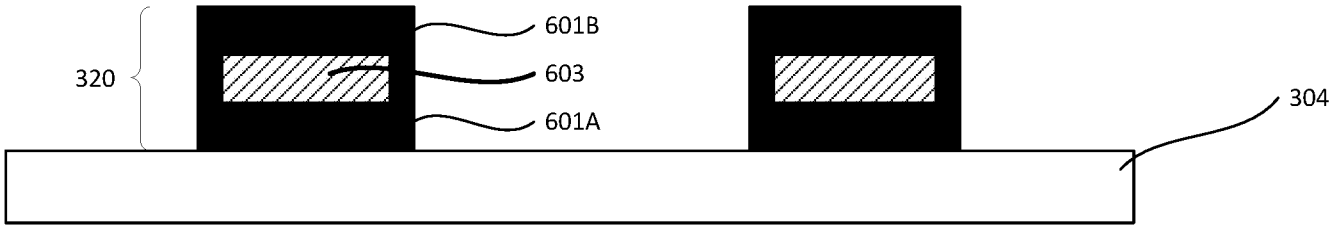
FIGS. 6A and 6B are illustrations of printed coating positions on filters in accordance with aspects of the present invention.
Figure 6B:
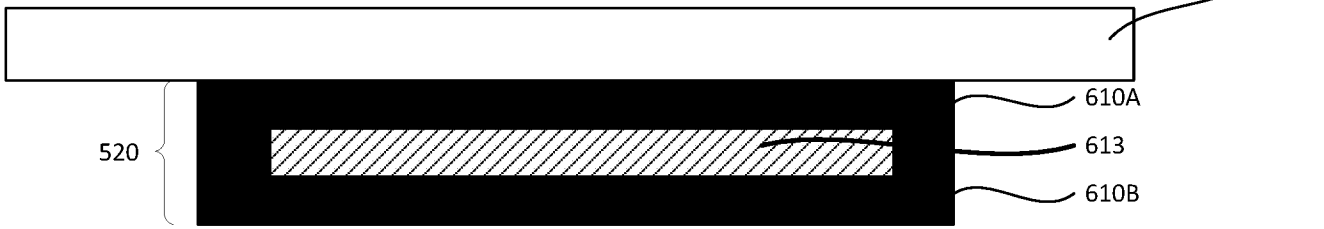

For example, FIGS. 6A and 6B illustrate example layers of compositions applied to the top (i.e., area in which the beverage medium is stored,) or bottom (i.e., area which faces the second compartment of the cartridge, such as compartment 220 of cartridge 200,) of a filters 304 and 504, respectively. Turning first to FIG. 6A, the filter 304 includes a coating 320 comprised of three layers 601A, 601B, and 603. Layers 601A and 601B and may be a urethane and layer 603 may be an epoxy. As illustrated in FIG. 6A, the epoxy layer 603 may be 2 mm thick and may be sandwiched between the two urethane layers 601A and 602B, which also may be 2 mm thick, to prevent an possible extraction and/or degradation of the epoxy layer by the pressurized liquid or other material which may contact the coating. In forming the coating, the first urethane layer 601A may be printed directly onto the top of the filter material and the epoxy layer 603 may be printed on the first urethane layer 601A. A second urethane layer 601B may be printed onto the epoxy layer 603, such that the two urethane layers 601A and 601B completely surround the epoxy layer 603. In the example of FIG. 6B, the first urethane layer 610A may be printed directly onto the bottom of the filter material and the epoxy layer 613 may be printed on the first urethane layer 610A. A second urethane layer 610B may be printed onto the epoxy layer 613, such that the two urethane layers 610A and 610B completely surround the epoxy layer 613. Although the above examples describe the layers as being 2 mm thick, the thickness of the layers may be more or less.

To apply the coating to the filter material, the coating may be printed on rolls of filter material, such that the coating may be applied at predetermined portions of the filter. In some instances, coatings may be applied on individual filters. Methods of printing/coating may include but are not limited to screen printing, digital printing, flexography, gravure, slot die coating, hot and/or cold laminating, roll coating, padding, reverse roll coating, curtain coating, etc. Upon being printed onto the rolls of filter material the compositions may be cured by one or more curing methods such as, but are not limited to, ultraviolet (UV) curing, electron beam (EB) curing, heat curing, cold curing, ambient catalyzed, and ambient crosslinked. In some embodiments a random coating pattern may be applied to the filter material.

The filter material may be die cut in-line. In this regard, the filter material may be cut by a die at particular location, and in a particular shape, to allow for the coating to at a predetermined location on the cut out filter. The cut out filter may then be pleated. For instance, a pleating press may pleat the cut out filter in a predetermined shape. Accordingly, when the filter is pleated and/or inserted into the cartridge, the coating may be positioned in the cartridge such that the pressurized fluid may permeate the filter as designed. In other words, by applying the coating at particular locations on the filter material and cutting the filter material at other particular locations, the cut out filter may assure the desired flow rate and flow pattern of the pressurized fluid through the filter. In some embodiments the filter material may be cut out of line and/or not pleated.

Supplements may be printed directly onto the filter and/or layered onto the coating. Supplements may include sweeteners, flavorings, fragrances, pharmaceuticals, nutrative compounds (e.g., nutraceuticals such as vitamins, botanicals (sativa, cannabis, herbs, etc.,), protein, caffeine, fiber, antioxidants, probiotics, other dietary supplements, etc.) or other such additives. In order to print the supplements, the supplements may be microencapsulated, dispersed, suspended and/or solubilized into a printable ink, such as carrageenan, xanthum gum, guar gum, or other such material. In some instances, a small amount of preservative, such as ascorbic acid may be included in the ink. In some instances, the ink may be configured such that the dissolving or dispersion of the supplement within the ink may be released over a period of time. For instance, starches may be mixed with polyvinyl alcohol and into one of the materials for generating the printable supplement such as carrageenan, xanthum gum, guar gum, etc. The period of dissolution or dispersion may be adjusted based on the amount of start, such as a slower period of dissolution or dispersion when more start is used and quicker dissolution or dispersion when less starch is used (or vice versa). In some instances a binder may be added to the ink to maintain the structural integrity of the substances therein. Further, supplements may be applied via printing to the walls, base, and/or lid of the cartridge.

A protective coating may be arranged around the exposed portion of the supplements, such that the supplement does not interact with the substance stored within the filter. In this regard the protective coating may be comprised of one or more of polyvinyl alcohol, xantham gum, or other such ingredient. In some instances the protective coating may form a vapor barrier, oxygen barrier, or to protect the coating from wear, such as during transport or handling of the cartridge, such that the substance within the filter doesn't scrape or wear away the coating or supplement.

In some embodiments food grade flavoring may be added to the coatings, such as coatings 320 and 520. In this regard, a flavoring may be microencapsulated, dispersed, suspended and/or solubilized into the coatings 320 and 520. Upon a particular pressurized fluid, such as, for example, water, contacting the coating, the flavoring of the coating may solubilize and mix into the pressurized fluid. By way of example, the flavoring may be a French vanilla flavoring, the pressurized fluid may be water, and the beverage medium in the cartridge may be coffee grounds. Upon the water being injected into the cartridge, such as cartridge 300 the water may contact the coating and solubilize the French vanilla flavoring and also contact the coffee grounds. As such the water may extract coffee from the coffee grounds and the solubilized French vanilla flavoring may mix into the coffee.

In some embodiments food grade fragrances may be added to the coatings, such as coatings 320 and 520. In this regard, a fragrance may be microencapsulated, dispersed, suspended and/or solubilized into the coating. Upon a particular pressurized fluid, such as, for example, water, contacting the coating, the fragrance of the coating may solubilize and an aroma may permeate into the air surrounding the fluid filtering process. By way of example, the fragrance may be hazelnut, the pressurized fluid may be water, and the beverage medium in the cartridge may be coffee grounds. Upon the water being injected into the cartridge 300 the water may contact the coating, such as coatings 320 and 520, and solubilize the hazelnut flavoring and also contact the coffee grounds. As such the water may extract coffee while a hazelnut aroma may enhance the brewing aroma.

Additionally, a fragrance that reduces or neutralizes that odor may be included in the coating, such as coatings 320 and 520. For example, a material being filtered may put out an off-putting scent, such as sulfur. To counter the sulfur scent, an added fragrance which reduces the sulfur odor may be included in the coating. As such, when the sulfur is filtered the added fragrance may alter the off-putting scent in the area surrounding the filter 304. In some embodiments both flavoring and fragrances may be added to the coating.

In some embodiments materials may be added to the coating, such as coatings 320 and 520, to create an oxygen and/or moisture barrier. In this regard, a material, such as polypropylene or desiccants, may be microencapsulated, dispersed, suspended and/or solubilized into the coating. These materials may increase the retardation effects of environmental interaction with the substances stored inside the filter. As such, selective blocking of oxygen and/or moisture in a given area or over the entire filter may increase the life of the substances within the filter.

Figure 7:
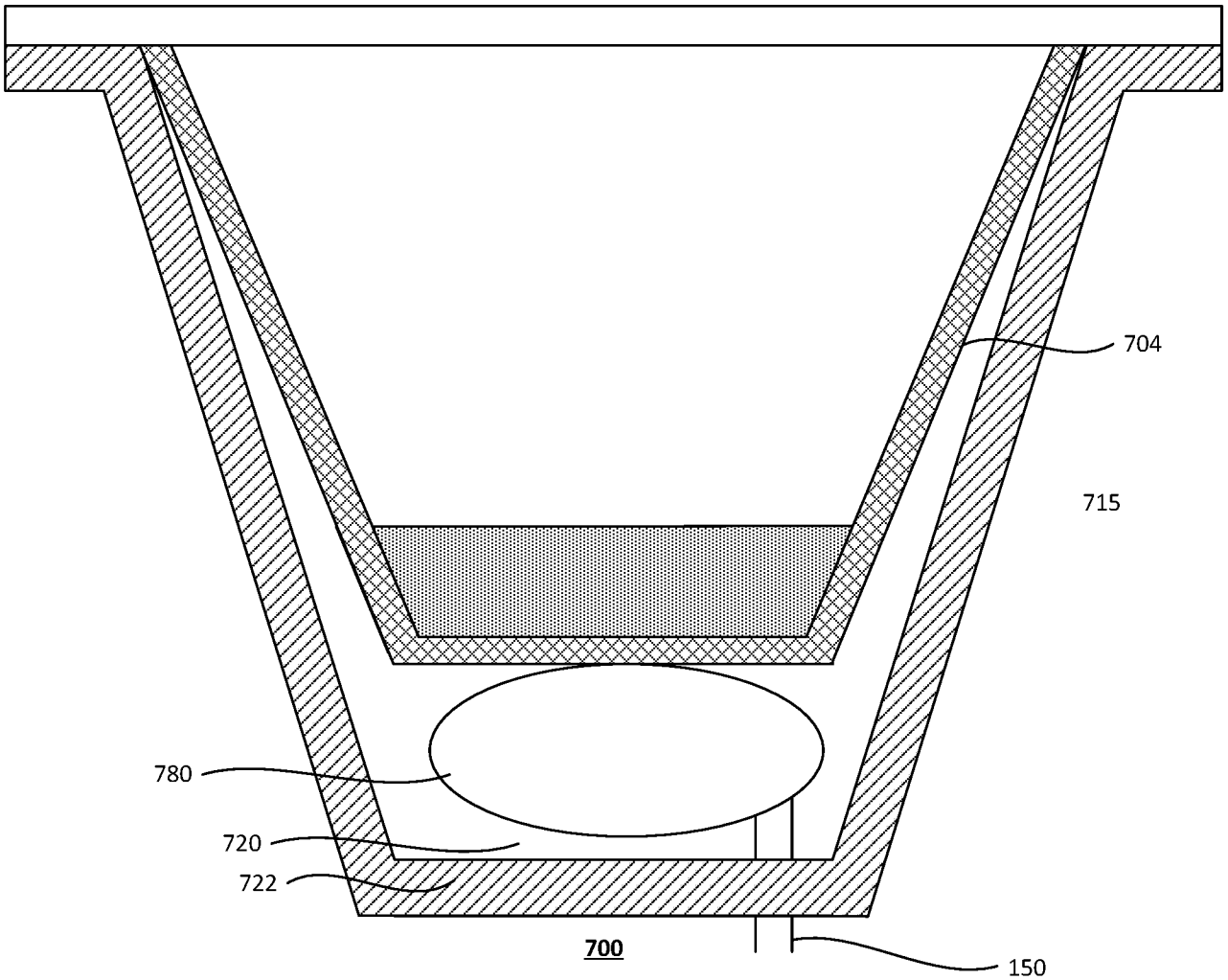
FIG. 7 is an illustration of a cartridge containing a pod in accordance with aspects of the present invention.

In some instances, pods may be placed in the base of the cartridge to prevent the extraction needle from piercing the filter. In this regard, the pod may be sufficiently dense to prevent the extraction needle from fully puncturing through the pod to prevent puncture of the filter. For instance, as shown in FIG. 7, cartridge 700 may include a pod 780, which is positioned in the second chamber 720. Upon the extraction needle 150 piercing the base of the cartridge 722, the pod may be pushed upwards by the needle, and into the filter 704. In some instance, the needle may pierce the exterior of the pod, but not pierce through the entirety of the pod 780.

In some instances, the pod, such as pod 780 may be water soluble. The water soluble pod can be made of Pullulan, sodium alginate, PVA, PVOH or other ingestible materials. The material can be clear or in color. In some instances the pod may contain flavoring, fragrance, and/or supplements within the interior and/or exterior film. In some examples, the film may be used as a container to store materials such as ingredients such as protein, coffee grounds, or other such ingredients that may be added to a beverage, either hot or cold. The pod may have a wall thickness between 10 to 200 microns, or more or less. The thickness of the wall of the soluble pod may be adjusted based upon the rate of dissolution desired upon the pressurized fluid contacting the pod. The thicker the pod the slower the rate of dissolution and the greater opportunity that the contents of the bag will end up being last out of the pod. As such, the contents of the pod may be configured to rest on top of the finished product after brewing.

Unless otherwise stated, the foregoing alternative examples are not mutually exclusive, but may be implemented in various combinations to achieve unique advantages. As these and other variations and combinations of the features discussed above can be utilized without departing from the subject matter defined by the claims, the foregoing description of the embodiments should be taken by way of illustration rather than by way of limitation of the subject matter defined by the claims.

The invention claimed is:

1. A beverage cartridge comprising:

a sidewall;

a bottom;

an opening;

a filter comprising a filter material arranged to separate the cartridge into a first compartment between the filter and the opening and a second compartment between the filter and the bottom, wherein the first compartment stores a first substance; and a printable coating printed on one or more portions of the filter material, wherein the coating increases the puncture resistance of the filter material, wherein the coating includes a first layer of urethane printed directly on the filter material, an epoxy printed over at least a portion of the first layer of urethane, and a second layer of urethane printed over the epoxy, wherein the epoxy is completely enclosed by the first layer of urethane and the second layer of urethane.

2. The beverage cartridge of claim 1 further comprising:

a lid sealing the opening, wherein the beverage cartridge has a frustoconical shape.

3. The beverage cartridge of claim 1, wherein the permeability of the filter is reduced at the one or more portions where the coating is printed.

4. The beverage cartridge of claim 1, wherein the one or more portions where the coating is printed includes all locations of the filter material.

5. The beverage cartridge of claim 1, wherein the coating comprises an ink including one or more of:

a solvent based resin, a water based resin, a free radical based resin, an oil based resin, a plastisol, and an organosol or any combination thereof.

6. The beverage cartridge of claim 1, wherein the first layer of urethane and the second layer of urethane are each about 2 mm thick.

7. The beverage cartridge of claim 1, wherein a first side of the filter is within the first compartment, and a second, opposite side of the filter is within the second compartment.

8. The beverage cartridge of claim 1, wherein at least one supplement is printed on the coating, wherein the supplement is selected from the group consisting of flavorings, fragrances, pharmaceuticals, and nutritive compounds.

9. A beverage cartridge comprising:

a filter comprising a filter material;

an enclosure at least substantially surrounding said filter; and a printable coating printed on the filter material, wherein the coating increases the puncture resistance of the filter material, wherein the coating includes an epoxy positioned between a first layer of urethane and a second layer of urethane wherein the epoxy is completely enclosed by the first layer of urethane and the second layer of urethane.

10. The beverage cartridge of claim 9, wherein the first layer of urethane is printed directly on the filter material, the epoxy is printed over at least a portion of the first layer of urethane, and the second layer of urethane is printed over the epoxy.

11. The beverage cartridge of claim 9, wherein the first layer of urethane and the second layer of urethane are each about 2 mm thick.

12. The beverage cartridge of claim 9, wherein the coating comprises an ink including one or more of a solvent based resin, a water based resin, a free radical based resin, an oil based resin, a plastisol, an organosol or any combination thereof.

13. The beverage cartridge of claim 9, wherein the enclosure comprises first and second compartments, a first side of the filter is within the first compartment, and a second, opposite side of the filter is within the second compartment.

14. The beverage cartridge of claim 9, wherein a first substance is arranged on the first side of the filter.

* * * * *